US010731330B2

(12) United States Patent
Petricca

(10) Patent No.: US 10,731,330 B2
(45) Date of Patent: Aug. 4, 2020

(54) CORBEL

(71) Applicant: Unistress Corp., Pittsfield, MA (US)

(72) Inventor: Perri Christopher Petricca, Lanesboro, MA (US)

(73) Assignee: UNISTRESS CORP., Pittsfield, MA (US)

( * ) Notice: Subject to any disclaimer, the term of this patent is extended or adjusted under 35 U.S.C. 154(b) by 0 days.

(21) Appl. No.: 16/168,511

(22) Filed: Oct. 23, 2018

(65) Prior Publication Data

US 2019/0119908 A1 Apr. 25, 2019

Related U.S. Application Data

(60) Provisional application No. 62/576,284, filed on Oct. 24, 2017.

(51) Int. Cl.

| | |
|---|---|
| ***E04B 1/41*** | (2006.01) |
| ***E04H 6/08*** | (2006.01) |
| ***E04B 1/04*** | (2006.01) |

(52) U.S. Cl.

CPC ..... *E04B 1/41* (2013.01); *E04B 1/043* (2013.01); *E04B 1/4114* (2013.01); *E04H 6/08* (2013.01); *E04B 2103/02* (2013.01)

(58) Field of Classification Search

CPC ..... E04B 1/41; E04B 1/4114; E04B 1/043; E04B 2103/02; E04H 6/08

See application file for complete search history.

(56) References Cited

U.S. PATENT DOCUMENTS

| | | | | |
|---|---|---|---|---|
| 3,981,109 | A * | 9/1976 | Termohlen | E04B 1/3404 52/125.1 |
| 4,479,916 | A | 10/1984 | Blatchford | |
| 7,640,702 | B2 * | 1/2010 | Termohlen | E04B 5/43 52/220.3 |
| 8,950,133 | B2 | 2/2015 | Hansort | |
| 2008/0279620 | A1 | 11/2008 | Berg | |
| 2010/0313518 | A1 | 12/2010 | Berg | |

(Continued)

FOREIGN PATENT DOCUMENTS

| | | |
|---|---|---|
| CN | 203066251 U | 7/2013 |
| CN | 104712058 A | 6/2015 |

(Continued)

OTHER PUBLICATIONS

JVI, "The Shooter Technical Data", 7131 North Ridgeway Avenue, Lincolnwood, IL 60712 USA, www.jvi-inc.com; Second Edition Mar. 29, 2016, Revised Dec. 5, 2016.

*Primary Examiner* — Patrick J Maestri

(74) *Attorney, Agent, or Firm* — Hamilton, Brook, Smith & Reynolds, P.C.

(57) ABSTRACT

A corbel for a wall including a corbel sleeve having a longitudinal passage for extending into the wall. At least one upright or vertically oriented elongate reinforcement member can be secured to the corbel sleeve and extend upwardly and downwardly therefrom for structurally engaging internal portions within the wall for structurally supporting the corbel sleeve. A corbel extension can have an insertion end and a support end. The insertion end can be inserted into the longitudinal passage of the corbel sleeve and secured therein. The support end can extend from the corbel sleeve and the wall, for example laterally, for supporting a load applied thereon.

21 Claims, 18 Drawing Sheets

(56) References Cited

U.S. PATENT DOCUMENTS

| | | | | |
|---|---|---|---|---|
| 2012/0096800 | A1 | 4/2012 | Berg | |
| 2015/0121797 | A1* | 5/2015 | Brown | E04B 1/483 52/699 |

FOREIGN PATENT DOCUMENTS

| | | | |
|---|---|---|---|
| CN | 105040827 | A | 11/2015 |
| CN | 205399683 | U | 7/2016 |
| DE | 102008061009 | A1 | 6/2010 |

* cited by examiner

TOP VIEW

SIDE VIEW

SECTION VIEW

SIDE VIEW

SECTION VIEW

TOP VIEW

SIDE VIEW

FRONT VIEW

TOP VIEW

SIDE VIEW

FRONT VIEW

SECTION

ELEVATION

TOP VIEW

SIDE VIEW

TOP VIEW

SIDE VIEW

FRONT VIEW

ELEVATION

SECTION

TOP VIEW

SIDE VIEW

FRONT VIEW

TOP VIEW

SIDE VIEW

TOP VIEW

SIDE VIEW

CORBEL

RELATED APPLICATION(S)

This application claims the benefit of U.S. Provisional Application No. 62/576,284, filed on Oct. 24, 2017. The entire teachings of the above application(s) are incorporated herein by reference.

BACKGROUND

Concrete double Tee beams such as in parking garages are typically supported at the ends by concrete walls having preformed structures such as pockets or ledges within the concrete walls, or corbels protruding from the walls. Concrete corbels tend to deteriorate of crumble over time, due to salt, water and ice, and can become structurally deficient. Replacing deteriorated concrete corbels can be difficult and expensive. Another drawback of such prior art preformed concrete structures is that typically the size of the pocket, ledge or corbel is not easily altered on-site during building.

SUMMARY

The present invention provides a corbel for a wall having embodiments that can be easily completed on-site if desired, can last longer than concrete corbels, and can allow dimensional changes in length to be made in order to compensate for larger than anticipated gaps between walls and double Tee beams. In some embodiments, the corbel can include a corbel sleeve having a longitudinal passage for extending into the wall. At least one upright or vertically oriented elongate reinforcement member can be secured to the corbel sleeve and extend upwardly and downwardly therefrom for structurally engaging internal portions within the wall for structurally supporting the corbel sleeve. A corbel extension can have an insertion end and a support end. The insertion end can be inserted into the longitudinal passage of the corbel sleeve and secured therein. The support end can extend from the corbel sleeve and the wall, for example laterally, for supporting a load applied thereon.

In particular embodiments, the at least one upright elongate reinforcement member can include four upright or vertically oriented reinforcement bars arranged in two longitudinally spaced pairs welded on opposite sides of the longitudinal passage of the corbel sleeve. The corbel sleeve can include rectangular tubing. The corbel extension can include rectangular tubing of smaller cross section with a support plate secured on the support end of the corbel extension to form a support surface. The corbel sleeve can include 5×7 inches×at least 0.25 inch wall steel rectangular tubing, and the corbel extension can include 4×6 inches×at least 0.25 inch wall steel rectangular tubing. The corbel can further include a wall formed of concrete having wall reinforcement members extending substantially a length and height of the wall. The at least one upright elongate reinforcement member can be secured to the corbel sleeve by welding, and structurally engaged relative to the wall reinforcement members for spreading loads exerted on the corbel extension and the corbel sleeve over at least a majority of the length and height of the wall, or a significant portion thereof. In some embodiments, the at least one upright elongate reinforcement member can include two reinforcement members, each including an elongate bar with a radially extending distal head secured to a plate. One reinforcement member can extend upwardly from an upper surface of the corbel sleeve from a back end, and another reinforcement member can extend downwardly from a lower surface of the corbel sleeve from a front end. In some embodiments, the corbel sleeve can be formed of plastic and include at least one load bearing or contact portion, member, element, sheet or plate positioned to form at least one desired contact point.

The present invention can also provide a corbel for a wall including a corbel extension having an insertion end and a support end. The insertion end for inserting into the wall and securing therein. The support end for extending from the wall for supporting a load applied thereon. At least one upright elongate reinforcement member can be secured relative to the corbel extension and extended upwardly and downwardly therefrom for structurally engaging internal portions within the wall for structurally supporting the corbel extension.

In particular embodiments, a corbel sleeve can be included and have a longitudinal passage for extending into the wall. The at least one reinforcement member can be secured to the corbel sleeve. The insertion end of the of the corbel extension can be inserted into the longitudinal passage of the corbel sleeve. In other embodiments, the at least one upright elongate reinforcement member can include two reinforcement members. Each reinforcement member can include an elongate bar with a radially extending distal head secured to a plate. One reinforcement member can extend upwardly relative to an upper surface of the corbel extension from a back end, and another reinforcement member can extend downwardly relative to a lower surface of the corbel sleeve from a front end.

The present invention can also provide a method of forming a corbel in a wall, including extending a corbel sleeve having a longitudinal passage into the wall. At least one upright or vertically oriented elongate reinforcement member can be secured to the corbel sleeve and extend upwardly and downwardly therefrom for structurally engaging internal portions within the wall for structurally supporting the corbel sleeve. An insertion end of a corbel extension can be inserted into the longitudinal passage of the corbel sleeve and secured therein. The corbel extension can also have a support end for extending from the corbel sleeve and the wall for supporting a load applied thereon.

In particular embodiments, the at least one upright reinforcement member can include four upright or vertically oriented elongate reinforcement bars arranged in two longitudinally spaced pairs welded on opposite sides of the longitudinal passage of the corbel sleeve. The corbel sleeve can include rectangular tubing. The corbel extension can include rectangular tubing with a support plate being secured on the support end of the corbel extension to form a support surface. The corbel sleeve can include 5×7 inches× at least 0.25 inch wall steel rectangular tubing and the corbel extension can include 4×6 inches×at least 0.25 inch wall steel rectangular tubing. The wall can be formed from concrete and have wall reinforcement members extending substantially a length and height of the wall. The least one upright elongate reinforcement member can be secured to the corbel sleeve by welding, and structurally engaged relative to the wall reinforcement members for spreading loads exerted on the corbel extension and the corbel sleeve over at least a majority of the length and height of the wall. In some embodiments, the at least one upright elongate reinforcement member can include two reinforcement members. Each reinforcement member can include an elongate bar with a radially extending distal head secured to a plate. One reinforcement member can extend upwardly from an upper surface of the corbel sleeve from a back end, and another reinforcement member can extend downwardly from a lower surface of the corbel sleeve from a front end. In some embodiments, the corbel sleeve can be formed of plastic and include at least one load bearing or contact portion, member, element, sheet or plate positioned to form at least one desired contact point.

The present invention can also provide a method of forming a corbel in a wall including inserting an insertion end of a corbel extension into the wall and securing therein. The corbel extension also having a support end for extending from the wall for supporting a load applied thereon. At least one upright elongate reinforcement member can be secured relative to the corbel extension and can extend upwardly and downwardly therefrom for structurally engaging internal portions within the wall for structurally supporting the corbel extension.

In particular embodiments, a corbel sleeve having a longitudinal passage can be extended into the wall. The at least one reinforcement member can be secured to the corbel sleeve. The insertion end of the corbel extension can be inserted into the longitudinal passage of the corbel sleeve. In other embodiments, the at least one upright elongate reinforcement member can include two reinforcement members. Each reinforcement member can include an elongate bar with a radially extending distal head secured to a plate. One reinforcement member can extend upwardly relative to an upper surface of the corbel extension from a back end, and another reinforcement member can extend downwardly relative to a lower surface of the corbel extension from a front end.

The present invention can also provide a method of supporting a load including extending a corbel from a wall. The corbel can include a corbel sleeve having a longitudinal passage extending into the wall. At least one upright or vertically oriented elongate reinforcement member can be secured to the corbel sleeve and extend upwardly and downwardly therefrom for structurally engaging internal portions within the wall for structurally supporting the corbel sleeve. A corbel extension having an insertion end and a support end, can have the insertion end inserted into the corbel sleeve and secured therein. The support end can extend from the corbel sleeve and the wall. The corbel can support the load on the support end of the corbel extension.

In particular embodiments, the at least one upright reinforcement member can include four upright or vertically oriented elongate reinforcement bars arranged in two longitudinally spaced pairs welded on the opposite sides of the longitudinal passage of the corbel sleeve. The corbel sleeve can include rectangular tubing. The corbel extension can include rectangular tubing with a support plate being secured on the support end of the corbel extension to form a support surface for supporting the load. The corbel sleeve can include 5×7 inches×at least 0.25 inch wall steel rectangular tubing, and the corbel extension can include 4×6 inches×at least 0.25 inch wall steel rectangular tubing. The wall can be formed of concrete and have wall reinforcement members extending substantially a length and height of the wall. The at least one upright elongate reinforcement member can be secured to the corbel sleeve by welding, and structurally engaged relative to the wall reinforcement members for spreading loads exerted on the corbel extension and the corbel sleeve over at least a majority of the length and height of the wall. The load can be directed along a face of the wall defined by the length and height of the wall. More than one corbel can be extended from the wall for supporting concrete structural members. The concrete structural members can include double Tee beams having two stems. Each stem of a double Tee beam can be positioned on top of the support end of a corresponding corbel extension. In some embodiments, the at least one upright elongate reinforcement member can comprise two reinforcement members. Each reinforcement member can include an elongate bar with a radially extending distal head secured to a plate. One reinforcement member can extend upwardly from an upper surface of the corbel sleeve from a back end, and another reinforcement member can extend downwardly from a lower surface of the corbel sleeve from a front end. In one embodiment, the corbel sleeve can be made of plastic and include at least one load bearing or contact portion, member, element, sheet or plate positioned to form at least one desired contact point.

The present invention can also provide a method of supporting a load including extending a corbel from a wall where the corbel includes a corbel extension having an insertion end and a support end. The insertion end is inserted into the wall and secured therein, and the support end extends from the wall. At least one upright elongate reinforcement member can be secured to the corbel extension and extend upwardly and downwardly therefrom for structurally engaging internal portions within the wall for structurally supporting the corbel extension. The load can be supported with the corbel, on the support end of the corbel extension.

Particular embodiments can include a corbel sleeve having a longitudinal passage extending into the wall. The at least one reinforcement member can be secured to the corbel sleeve. The insertion end of the corbel extension can be inserted into the longitudinal passage of the corbel sleeve. In other embodiments, the at least one upright elongate reinforcement member can include two reinforcement members. Each reinforcement member can include an elongate bar with a radially extending distal head secured to a plate. One reinforcement member can extend upwardly relative to an upper surface of the corbel extension from a back end, and another reinforcement member can extend downwardly relative to a lower surface of the corbel extension from a front end.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

Figure 1:
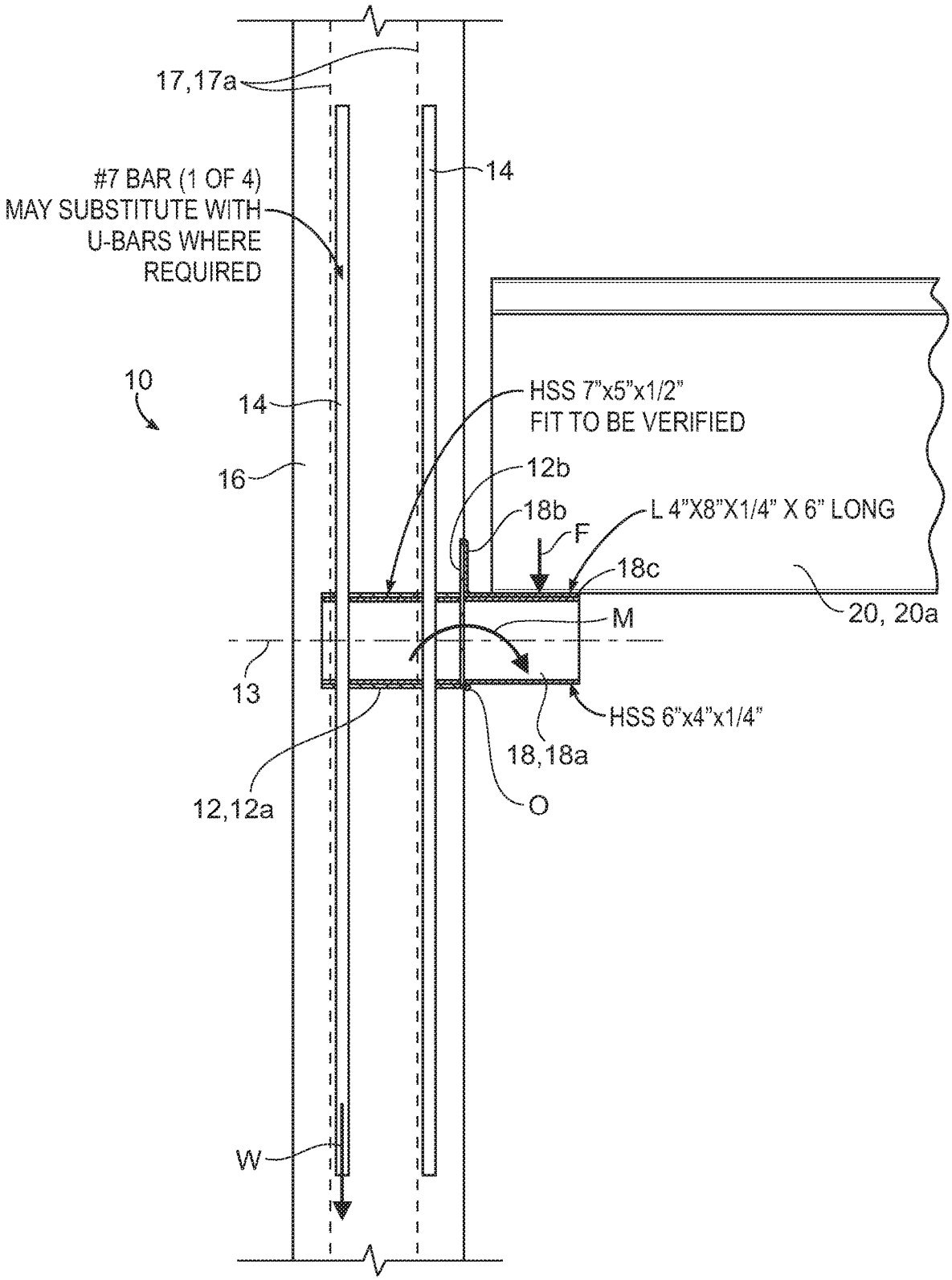
FIG. 1 is a schematic side sectional view of a concrete wall with an embodiment of a corbel in the present invention supporting a stem of a double Tee beam.
Figure 2A:
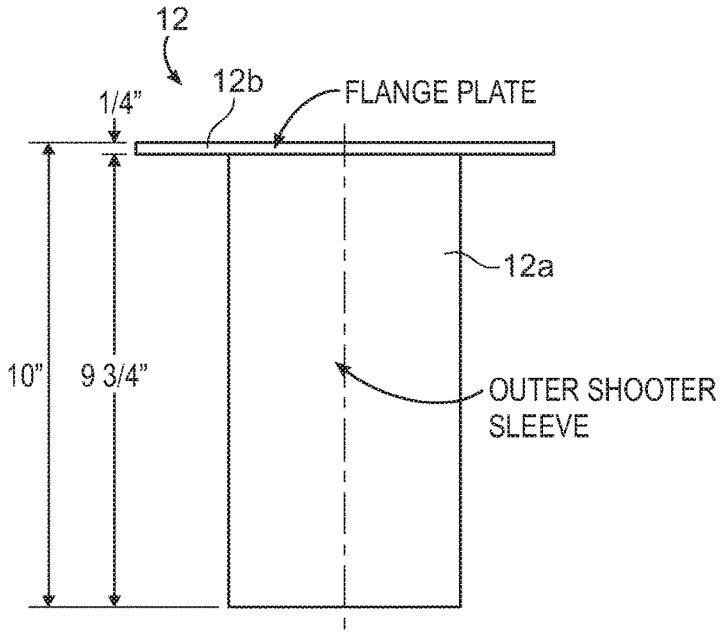
FIGS. 2A, 2B and 2C are top, side and section views of an embodiment of a corbel outer sleeve or insert portion in the present invention.
Figure 2B:
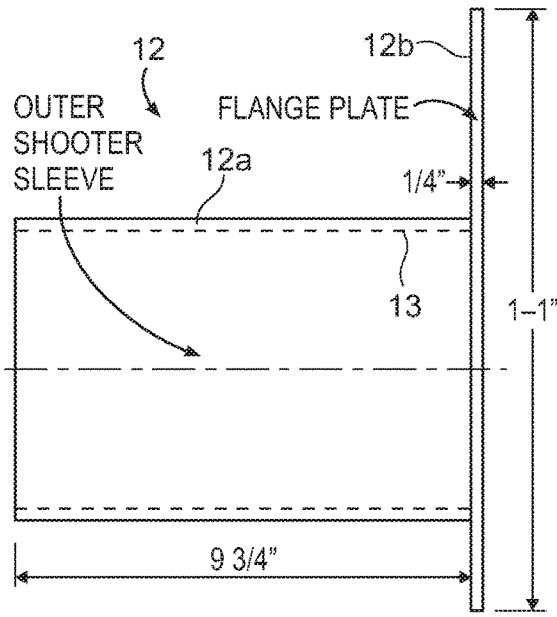
Figure 2C:
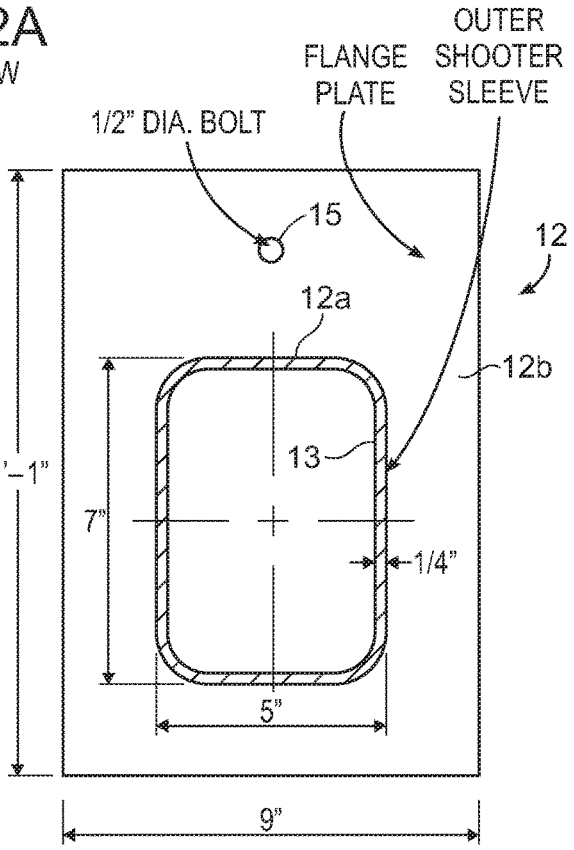
Figure 3A:
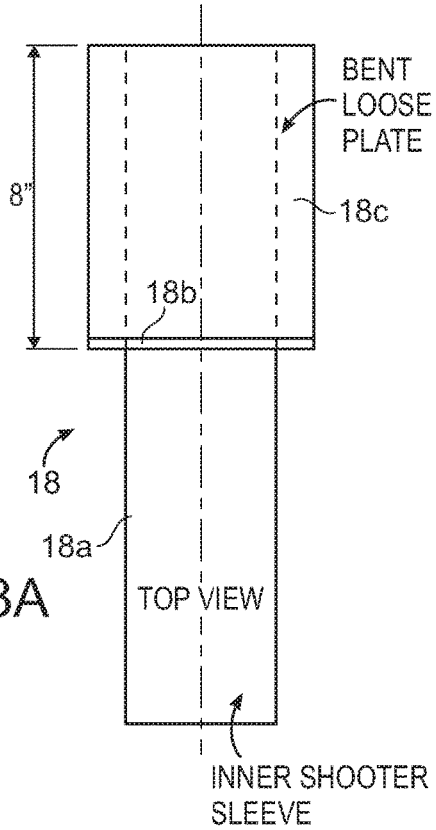
FIGS. 3A, 3B and 3C are top, side and section views of an embodiment of a corbel extension portion in the present invention.
Figure 3B:
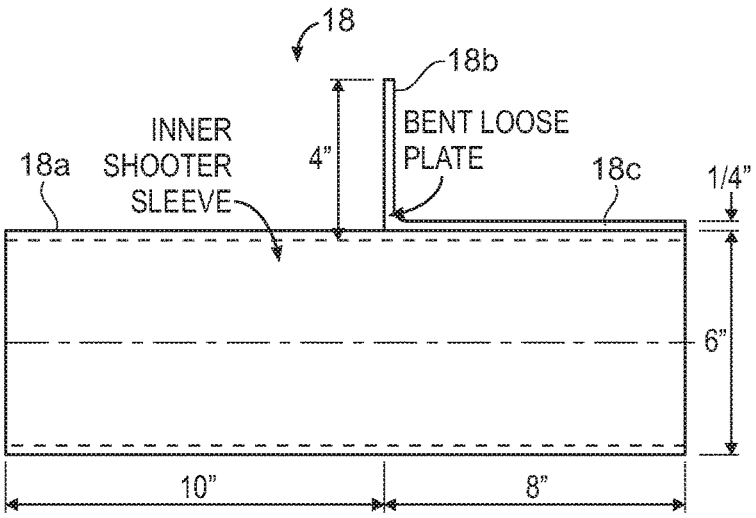
Figure 3C:
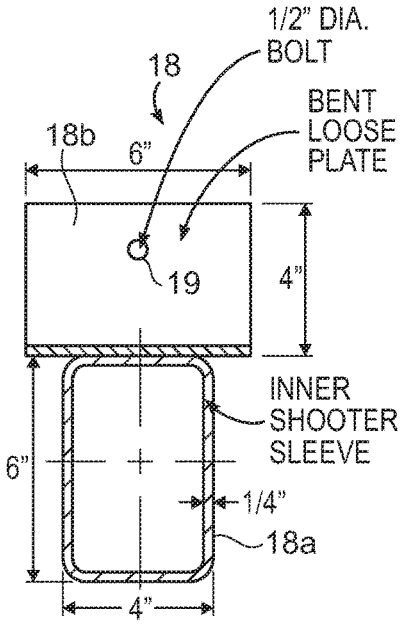
Figure 4:
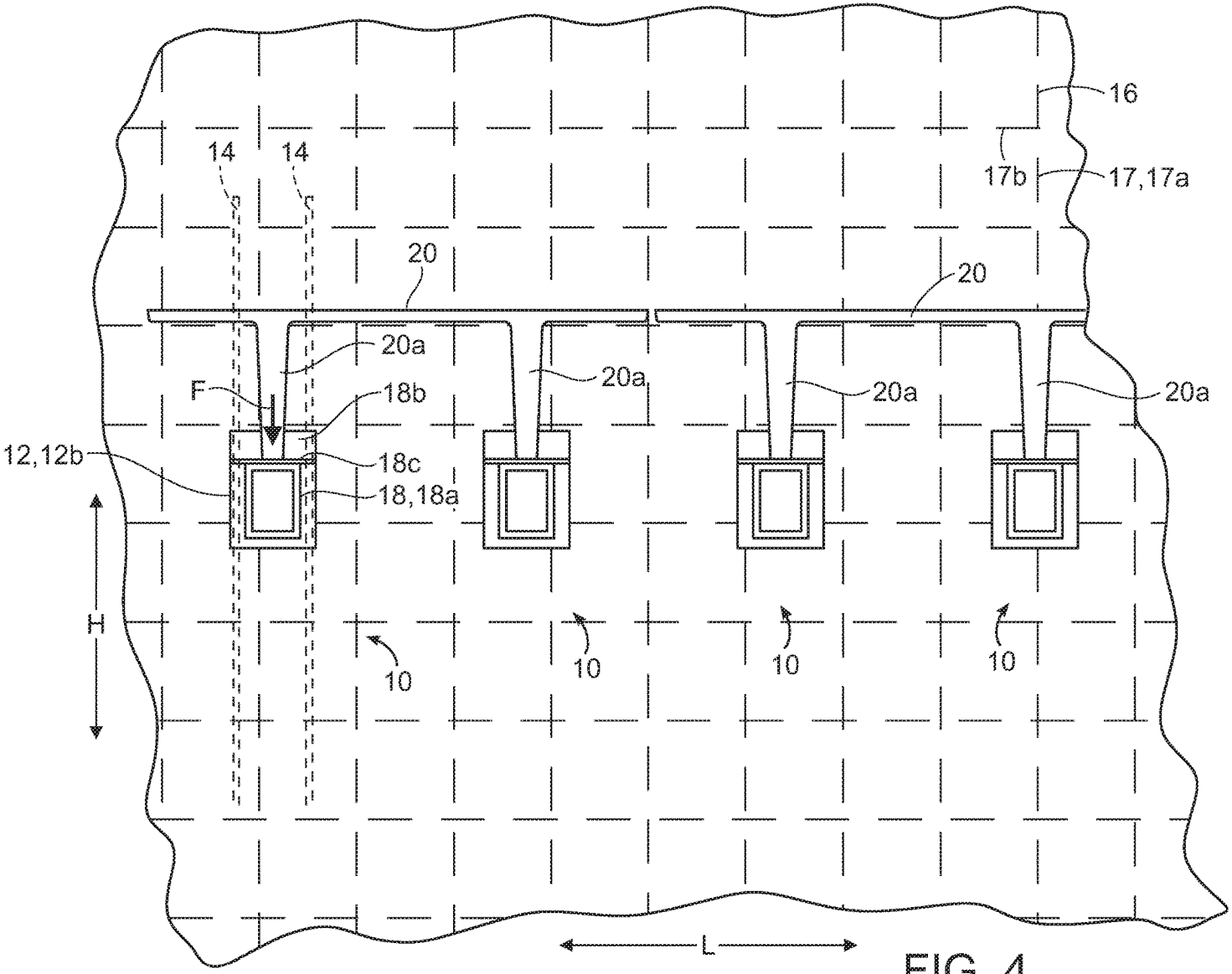
FIG. 4 is a schematic front view of a portion of a concrete wall including multiple corbels in the present invention supporting corresponding stems of multiple double Tee beams.

Referring to FIGS. 1-4, an embodiment of a corbel 10 in the present invention can be formed into or include a precast concrete wall 16 such as in a multilevel parking garage, for supporting precast concrete double Tee members or beams 20 at the ends. The double Tee beams 20 can form the support surfaces on which cars can be driven over and parked.

The corbel 10 can include a corbel outer sleeve or insert portion 12 (FIGS. 2A-2C) and a corbel extension portion 18 (FIGS. 3A-3C), that can be made of steel. The insert portion 12 can have a laterally extending or oriented elongate corbel outer sleeve member 12*a* welded or secured by other suitable mechanical means such as fasteners, connecting pieces, tying or capturing, for rigid or secure structural engagement, to lengths of upright or vertically extending or oriented steel reinforcement members, rods, bars or rebar 14. In one embodiment, the rebar 14 can be four lengths of #7 rebar arranged in two longitudinally spaced pairs on opposite sides of the longitudinal passage 13 of the insert portion 12 and corbel outer sleeve member 12*a*. In another embodiment, the legs of two U-shaped lengths of rebar 14 can be secured to opposite sides of the outer sleeve member 12*a*. The insert portion 12 can be cast with concrete into the concrete wall 16. The rebar 14 can be secured, connected to or structurally integrally or rigidly engaged with internal wall reinforcement members or rebar 17 (FIG. 4) of the wall 16. The rebar 17 can have vertical 17*a* and/or horizontal 17*b* members extending substantially along the length L and height H of the wall 16. The rebar 17 can structurally support the insert portion 12, the rebar 14 and the corbel outer sleeve member 12*a*. The outer sleeve member 12*a* can be formed of elongate rectangular steel tubing and a steel flange plate 12*b* can be welded upright or vertically to one axial end. The central lateral or longitudinal passage 13 therethough can extend laterally into the wall 16. The insert portion 12 can be cast into the wall 16 in a manner where the surface of the flange plate 12*b* can be exposed on the planar surface of the wall 16.

Before the double Tee 20 can be installed, a lateral elongate corbel extension portion 18 (FIGS. 3A-3C) of the corbel 10, can be secured to or within the outer sleeve member 12*a* and the insert portion 12, to extend laterally from the concrete wall 16. The corbel extension 18 can have an inner sleeve member 18*a* formed of elongate rectangular steel tubing with an insertion end that is sized smaller to be inserted into the longitudinal passage 13 of the outer sleeve member 12*a* within the concrete wall 16. The corbel extension 18 has a support end with a steel support plate having an upright or vertical flange 18*b* and a lateral plate portion or support surface 18*c* on the upper surface of the end of the inner sleeve member 18*a* that extends from the concrete wall 16. The flange 18*b* can be located at about the middle of the inner sleeve member 18*a* and mates with and can be bolted through holes 15 and 19, welded, fastened or otherwise secured to the flange plate 12*b* of the insert portion 12 for securing the corbel extension 18 to the insert portion 12. The pieces of rectangular tubing can also be welded together. The length of the inner sleeve member 18*a* and the support surface 18*c* extending laterally from the concrete wall 16 forms a corbel or support structure on which the end of the legs or stems 20*a* of the double Tee 20 can rest upon and the corresponding load or force F can be supported when installed. Typically, each double Tee 20 has two stems 20*a* which are each supported by corresponding corbels 10 extending from concrete walls 16 located on opposite ends of the double Tee 20.

Since the corbel extension 18 can be easily installed by insertion and securement by bolting or welding at the time the double Tee 20 is installed, a corbel extension 18 with a long enough support surface can be selected to make sure that the support surface 18*c* laterally protrudes far enough from the concrete wall 16 to properly support the double Tee 20, and longer ones can be selected to compensate for unforeseen gaps between the concrete wall 16 and the double Tee 20. In addition, the width of the support surface 18*c* can be wider than the inner sleeve member 18*a* in order to provide a wide enough surface to support the width of a stem 20*a*, and to compensate for any side to side variation.

By structurally connecting, securing or engaging the upright reinforcement rebar 14 of the insert portion 12 to the rebar 17 within a planar upright wall 16 such as by abutting, welding, fasteners, connecting pieces, tying or capturing, prior to casting, loads F exerted on the corbel extension 18 and outer sleeve member 12*a* (which extend perpendicular to the plane of the wall 16 and the narrow dimension or thickness of wall 16) can be spread over at least a majority of the length and height of the wall 16 by the rebar 17, or a significant portion thereof. The load or force F from a stem 20*a* of a double Tee beam 20 is generally directed downwardly along the planar face of the wall 16 defined by the length L and height H of the wall 16 and can be slightly offset or away from the surface. In addition, the load F can also exert a moment M (FIG. 1) on the corbel 10 about pivot point O at the junction of outer sleeve member 12*a* and the surface of wall 16. With the rebar 17 being structurally engaged with rebar 14 of insert portion 12 and extending substantially along the length L and height H of the wall 16, the moment M about pivot point O can be resisted by the weight W of the wall 16 or a significant portion thereof, thereby ensuring rigidity of corbel 10. The longitudinally spaced apart pairs of the upright rebar 14 can also provide increased reinforcement surface area and strength resisting force F and moment M from pulling the insert portion 12 from the wall 16. In some embodiments, the rebar 14 does not have to be secured to rebar 17. However, by extending the rebar 14 both upwardly and downwardly from insert portion 12 and corbel extension 18 within the wall 16 a sufficient distance, the load F and moment M can be sufficiently resisted by rebar 14 and wall 16.

FIGS. 1-3C include dimensions for one embodiment in the present invention, and it is understood that the dimensions can be changed for different embodiments, including the other following embodiments where dimensions are given.

In one embodiment, the wall 16 can be about one foot thick. The insert portion 12 can be about 10 inches long and the outer sleeve member 12*a* can be steel rectangular tubing about 5 inches wide×7 inches high×¼ inch wall×9¾ inches long. Flange plate 12*b* can be about 9 inches wide×13 inches high×¼ inch thick. The insert portion 12 and longitudinal passage 13 can extend laterally or horizontally into the wall 16 about 10 inches. The corbel extension 18 can be about 18 inches long and the inner sleeve member 18*a* can be steel rectangular tubing about 4 inches wide×6 inches high×¼ inch wall×18 inches long. Flange 18*b* and support surface 18*c* can be formed from a bent 90 degree plate where flange 18*b* can be about 6 inches wide×4 inches high×¼ inch thick, and support surface 18*c* can be about 6 inches wide×8 inches long by ¼ inch thick. The inner sleeve member 18*a* can extend into the insert portion 12 by an amount equal to the length of the longitudinal passage 13 (for example 10 inches) for full surface engagement therein, which can spread forces from the inner sleeve member 18*a* over the length of the insert portion 12. The end of the inner sleeve member 18*a* can abut the end of longitudinal passage 13 such that the portion of the inner sleeve member 18*a* within the insert portion 12 can be longitudinally constrained between the end of longitudinal passage 13 and flange plate 12*b*. In some embodiments, the concrete can fill the interior of the inner sleeve member 18*a*. The rebar 14 can extend above and below the outer sleeve member 12*a* of the insert portion 12 at least about 5 to 5½ heights of the outer sleeve member 12*a*, which can be about 35-40 inches, such as 38 inches. The pairs of rebar 14 can also be longitudinally spaced along passage 13 apart from each other about 6-7 inches, and spaced on opposite sides of passage 13 by about 5 inches. Such lengths of the paired and spaced rebar 14 can internally engage the concrete and/or rebar 17 within the wall 16 to distribute forces F exerted on the corbel 10 over a significant or majority of the wall 16 over a large area above, below and/or to the sides of the insert portion 12, so that the concrete and rebar 17 can readily resist cracking or crumbling of the wall 16, or pulling of the insert portion 12 from the planar face of the wall 16. The rebar 14 can also form two spaced pairs of tall H-shaped reinforcing structures on the insert portion 12, looking both in the longitudinal and lateral directions, and can develop an upright column of concrete defined or surrounded by the rebar 14 encompassing at least a portion of the outer sleeve member 12*a* extending above and below the outer sleeve member 12*a*, providing a solid anchor.

Figure 5A:
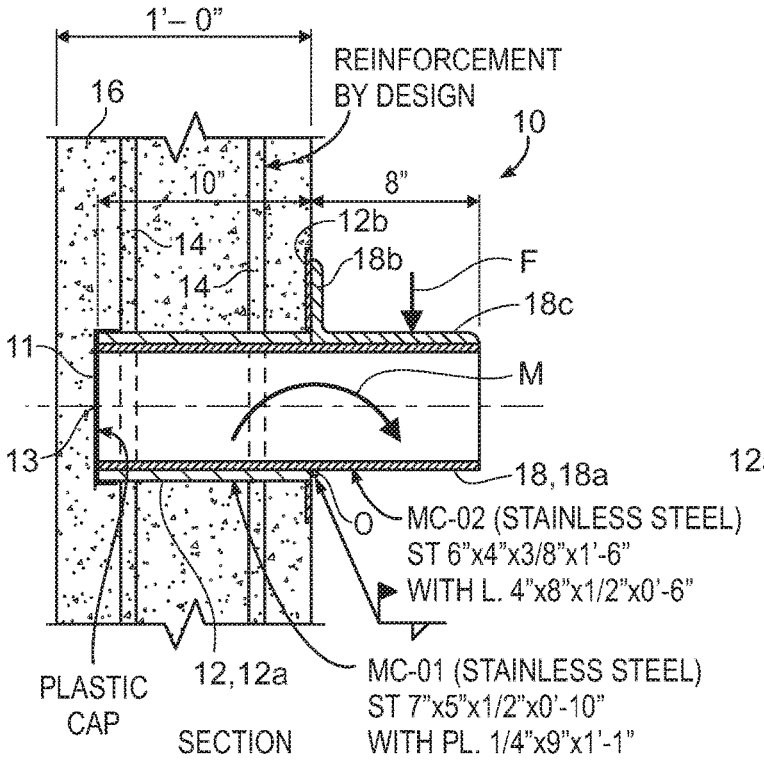
FIGS. 5A, 5B and 5C are section, elevation and perspective view assembly drawings of another embodiment of a corbel in the present invention.
Figure 5B:
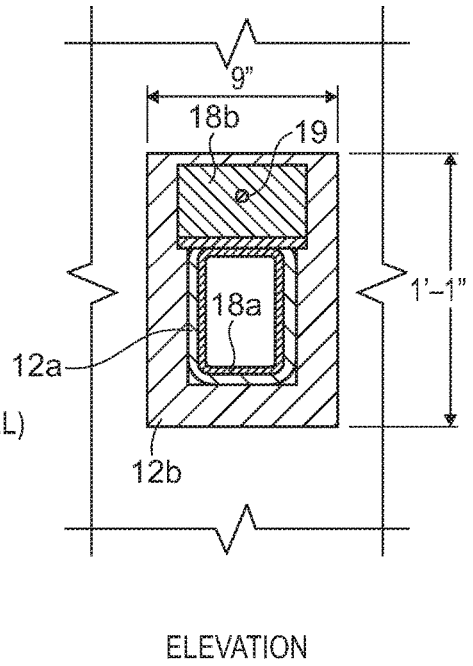
Figure 5C:
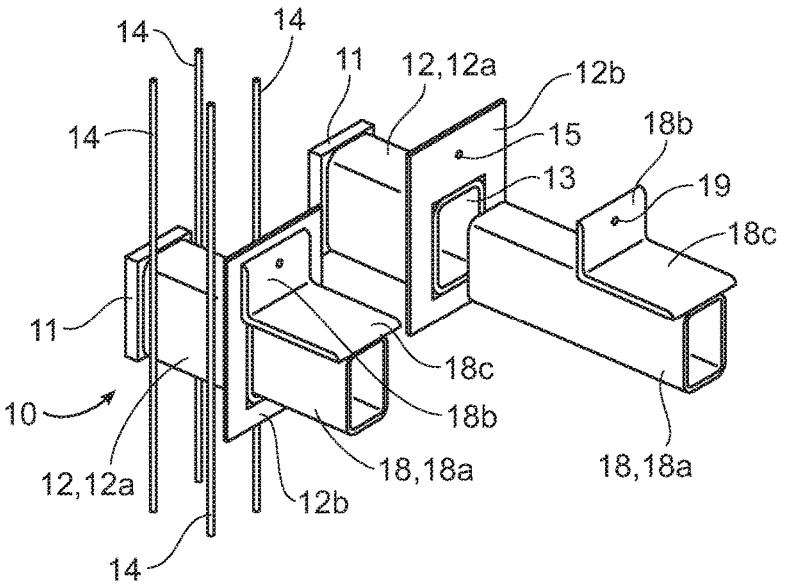
Figure 6A:
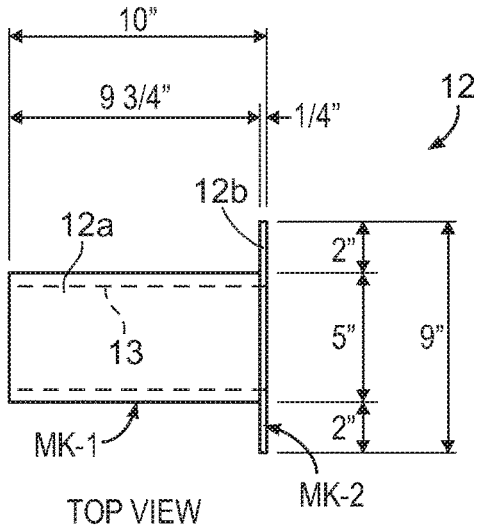
FIGS. 6A, 6B and 6C are top, side and front view detail drawings of the corbel outer sleeve or insert portion of the embodiment of FIGS. 5A-5C.
Figure 6B:
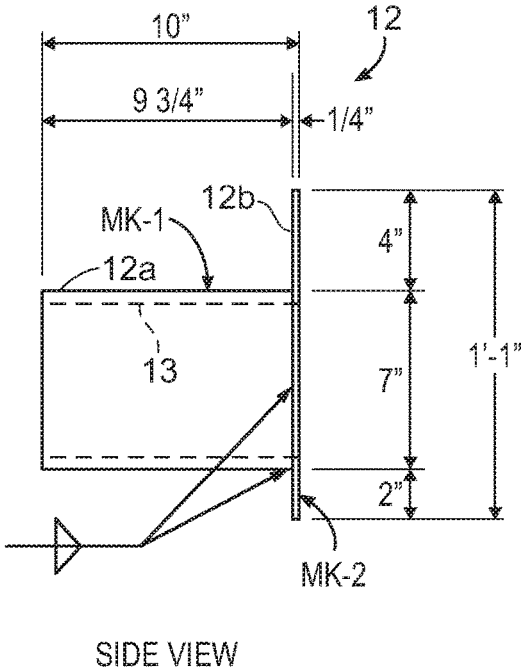
Figure 6C:
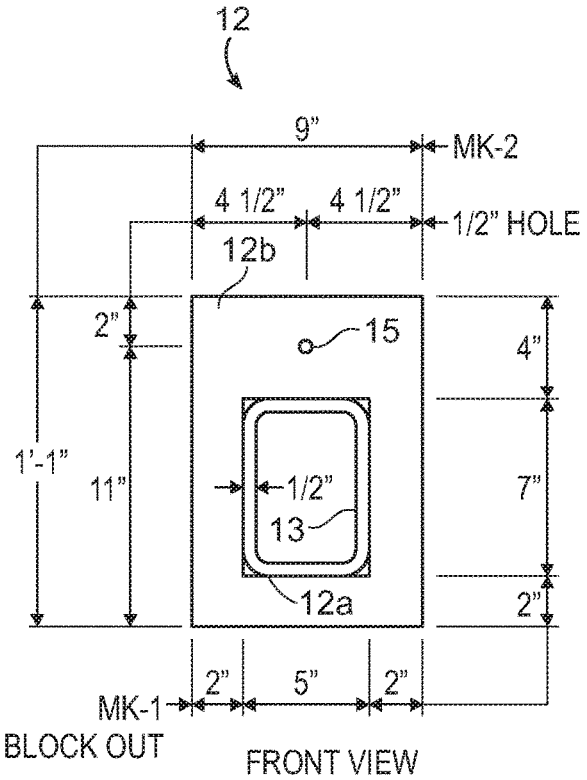
Figure 7A:
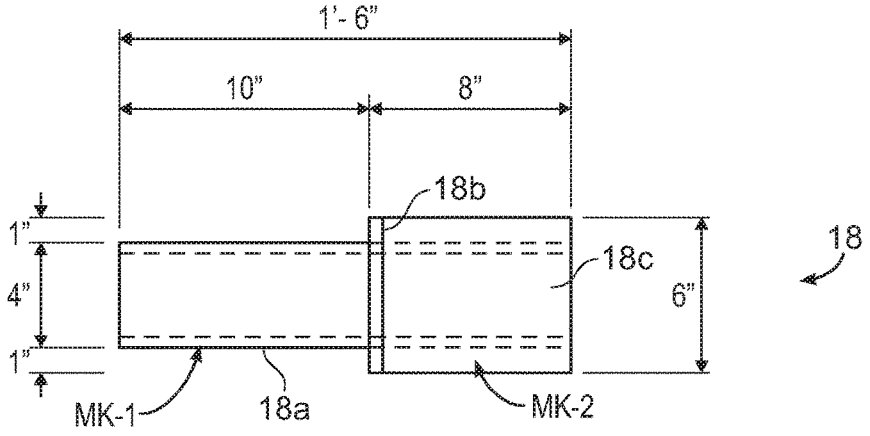
FIGS. 7A, 7B and 7C are top, side and front view detail drawings of the corbel extension portion of the embodiment of FIGS. 5A-5C.
Figure 7B:
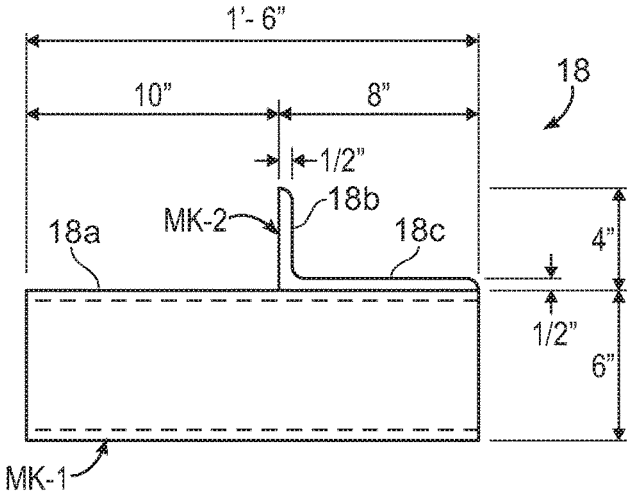
Figure 7C:
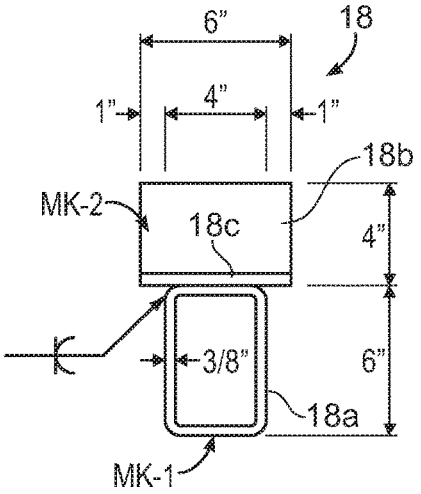

FIGS. 5A-7C show another embodiment of a corbel 10 in the present invention in which the insert portion 12 and corbel extension 18 can be made of stainless steel, and the wall thicknesses of the rectangular stainless steel tubing can be increased to ⅜ inch for inner sleeve member 18*a* and ½ inch for outer sleeve member 12*a*. The end of the insert portion 12 that is cast within wall 16 can be covered or sealed by a plastic or steel end cap 11 to prevent concrete from entering. The rebar 14 can be cast into wall 16 and does not have to engage rebar 17 of the wall 16. In some embodiments, the rebar 14 can be abutted against the sides of outer sleeve member 12*a*, and can be considered secured or engaged thereto by the concrete. Further dimensions are found in FIGS. 5A-7C.

Figure 8A:
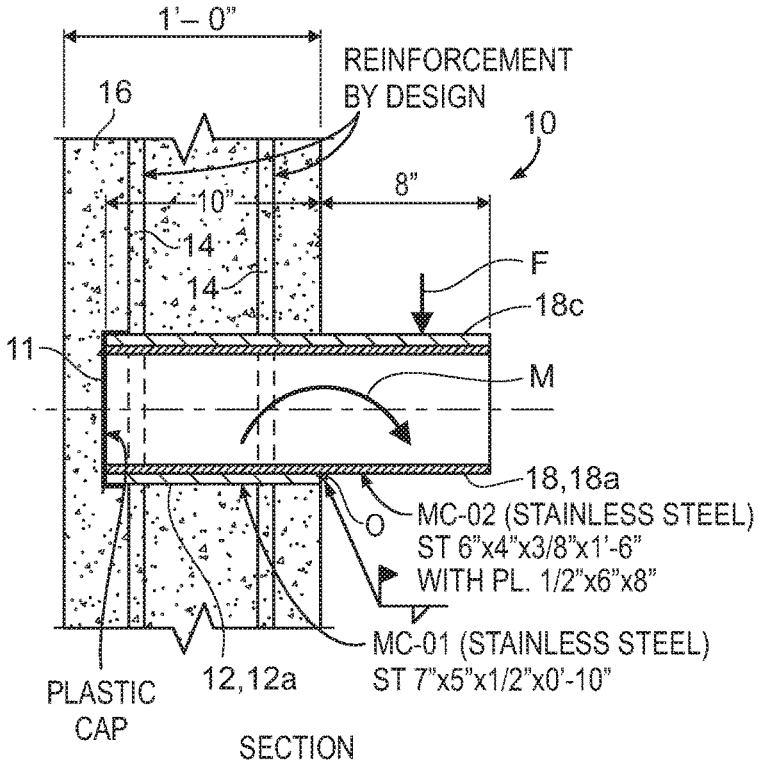
FIGS. 8A, 8B and 8C are section, elevation and perspective view assembly drawings of yet another embodiment of a corbel in the present invention.
Figure 8B:
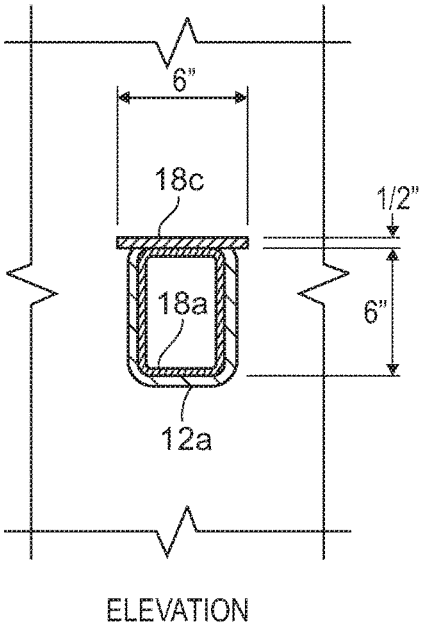
Figure 8C:
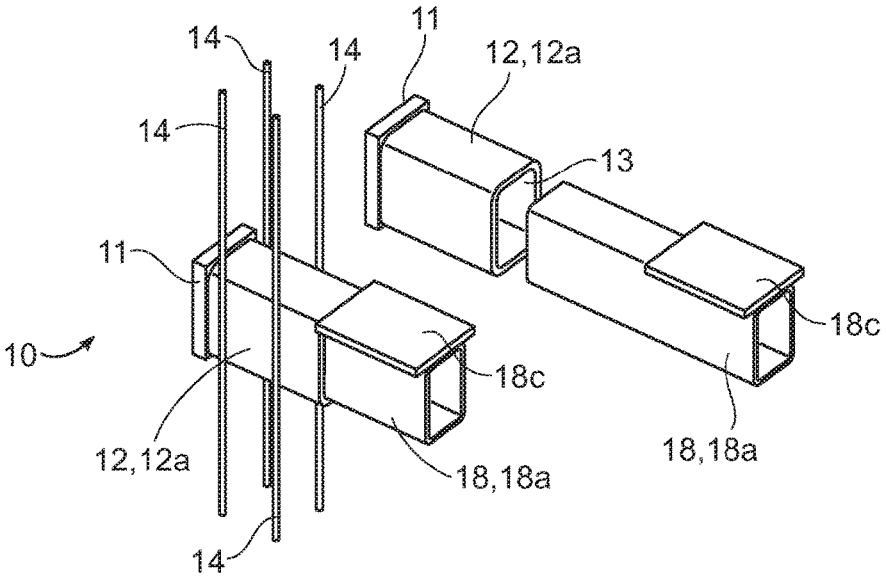
Figure 9A:
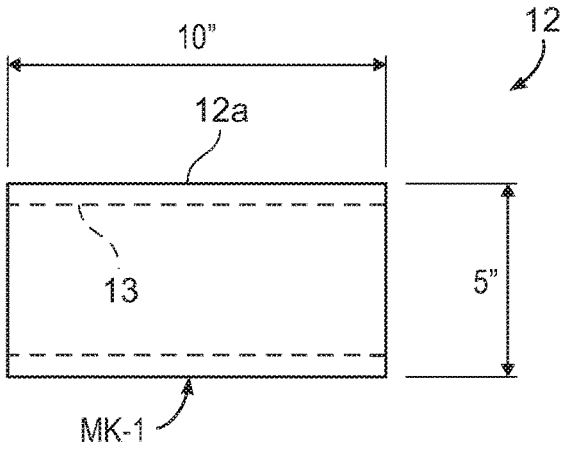
FIGS. 9A, 9B and 9C are top, side and front view detail drawings of the corbel outer sleeve or insert portion of the embodiment of FIGS. 8A-8C.
Figure 9B:
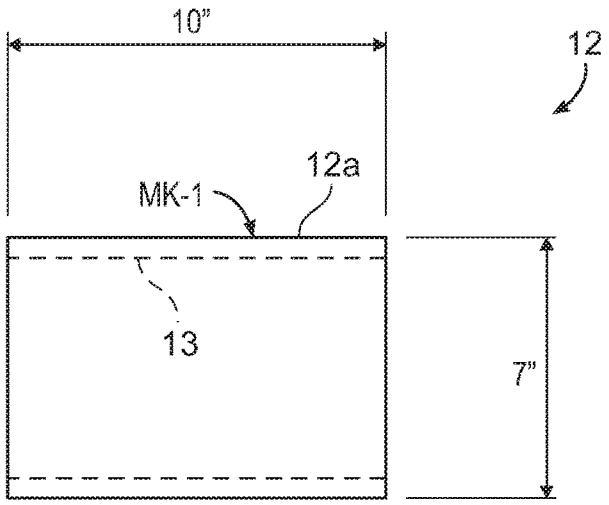
Figure 9C:
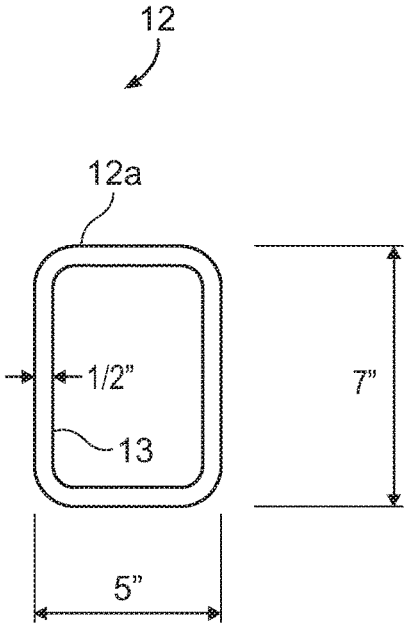
Figure 10A:
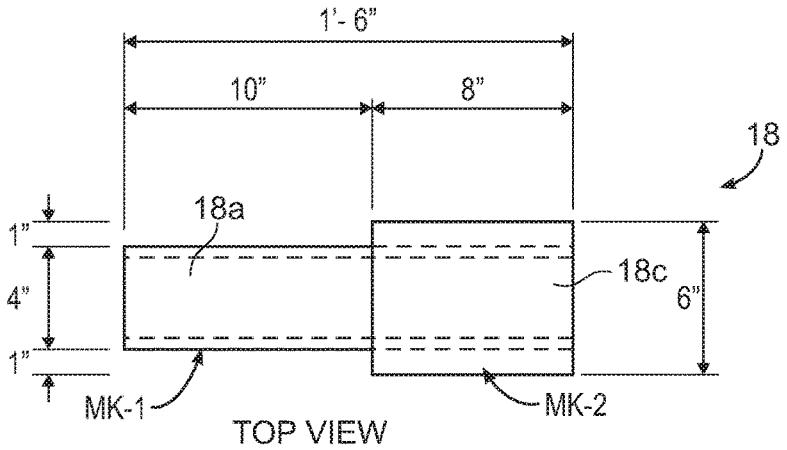
FIGS. 10A, 10B in 10C are top, side and front view detail drawings of the corbel extension portion of the embodiment of FIGS. 8A-8C.
Figure 10B:
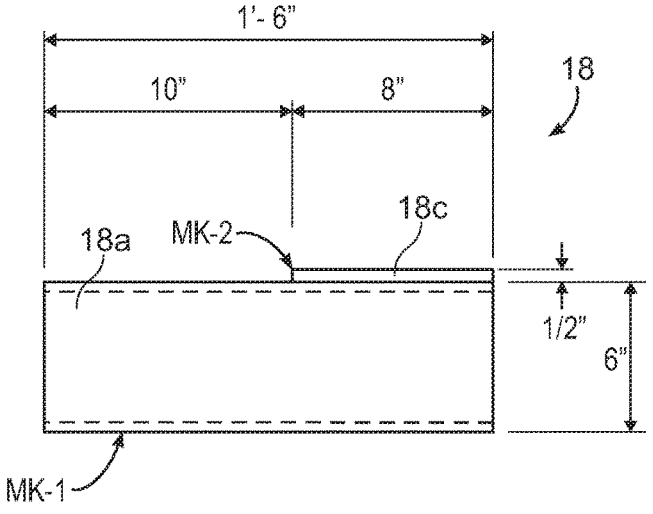
Figure 10C:
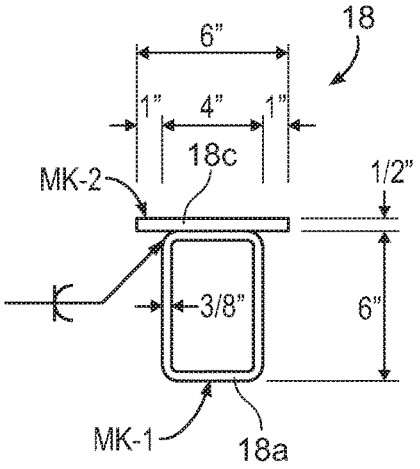

FIGS. 8A-10C show yet another embodiment of a corbel 10 in the present invention which differs from the embodiment of FIGS. 5A-7C in that the flange plate 12*b* is omitted from the insert portion 12, and the upright flange 18*b* is omitted from the corbel extension 18. The outer sleeve member 12*a* and the inner sleeve member 18*a* can be secured together by welding or by other suitable means. Further dimensions are found in FIGS. 8A-10C.

Figure 11A:
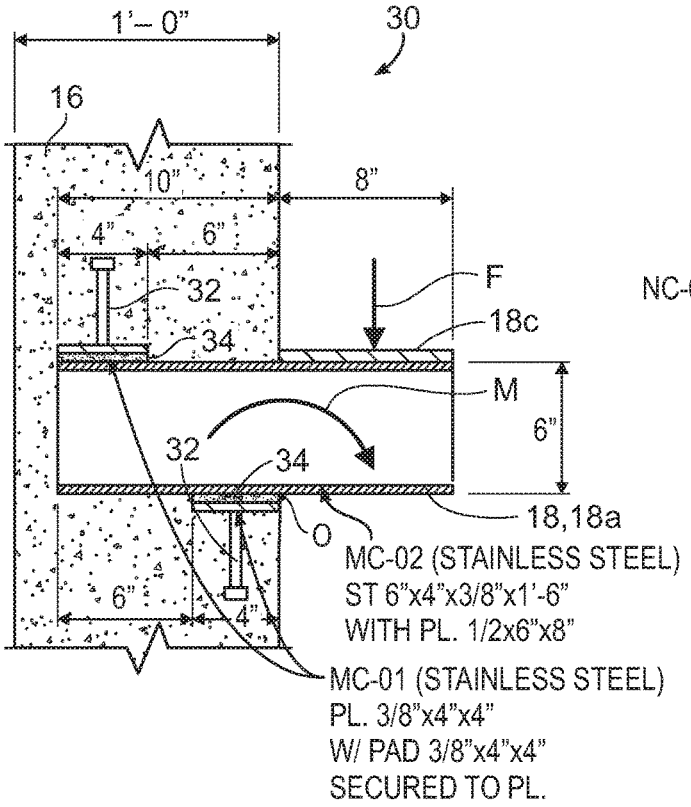
FIGS. 11A and 11B are section and elevation view assembly drawings of still another embodiment of a corbel in the present invention.
Figure 11B:
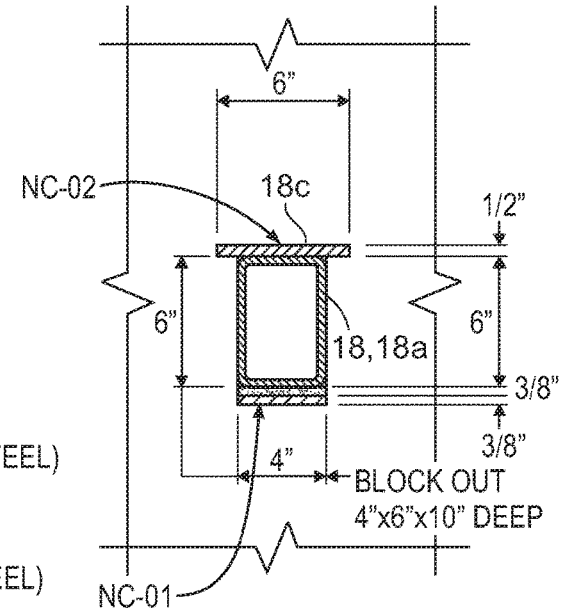
Figure 12A:
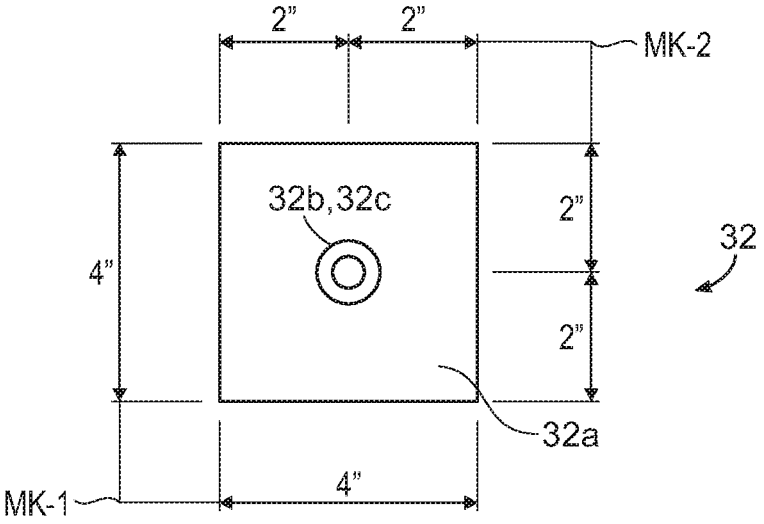
FIGS. 12A and 12B are top and side view detail drawings of a reinforcement member in the embodiment of FIGS. 11A and 11B.
Figure 12B:
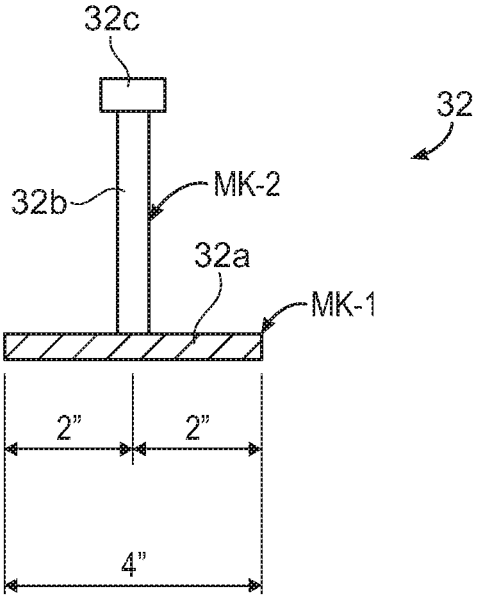
Figure 13A:
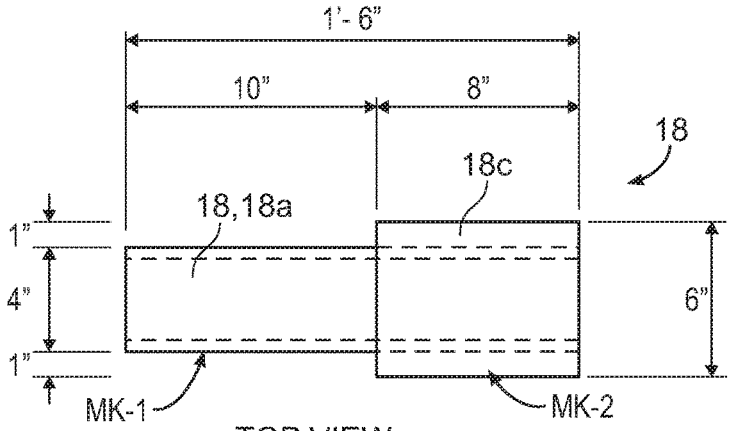
FIGS. 13A, 13B and 13C are top, side and front view detail drawings of the corbel extension portion of the embodiment of FIGS. 11A and 11B.
Figure 13B:
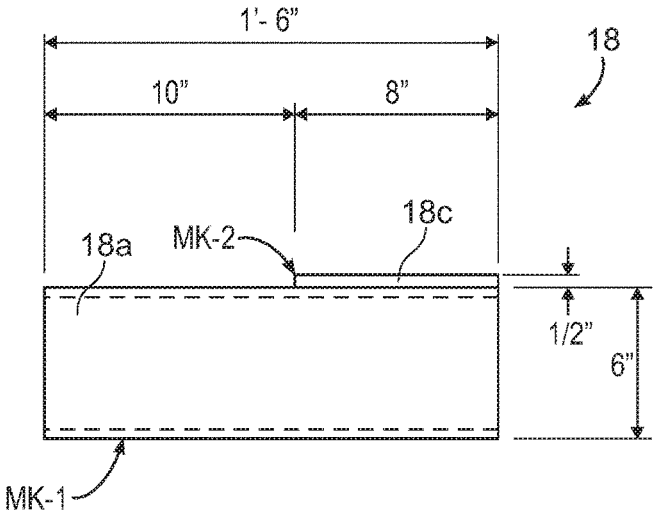
Figure 13C:
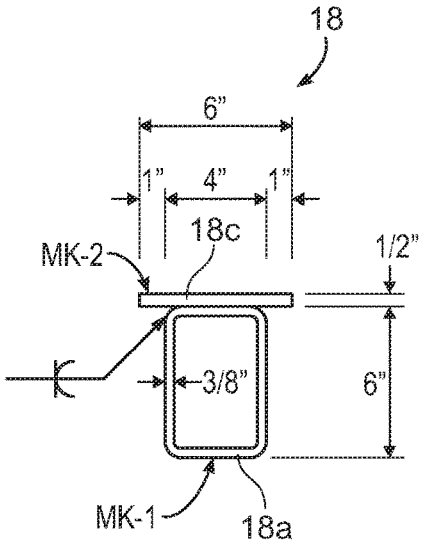

FIGS. 11A-13C show still another embodiment of a corbel 30 in the present invention which differs from the embodiment shown in FIGS. 8A-10C, in which the insert portion 12 is omitted. Two upright elongate stainless steel reinforcement members 32 are secured to the upper rear or back and lower front surfaces of the corbel extension 18 within wall 16 via intermediate plates 34, such as by welding, bolting, the concrete, or other suitable means. Each reinforcement member 32 can include a square plate 32*a* from which an elongate rod or bar 32*b* extends (for example in some embodiments about 4 inches), and has a distal head 32*c* extending radially. The longitudinally staggered rear upward and front downward positions of the reinforcement members 32 in the concrete wall 16 is a configuration that can resist the force F and moment M with the material of wall 16 providing lateral resistance. Further dimensions are found in FIGS. 11A-13C.

Figure 14B:
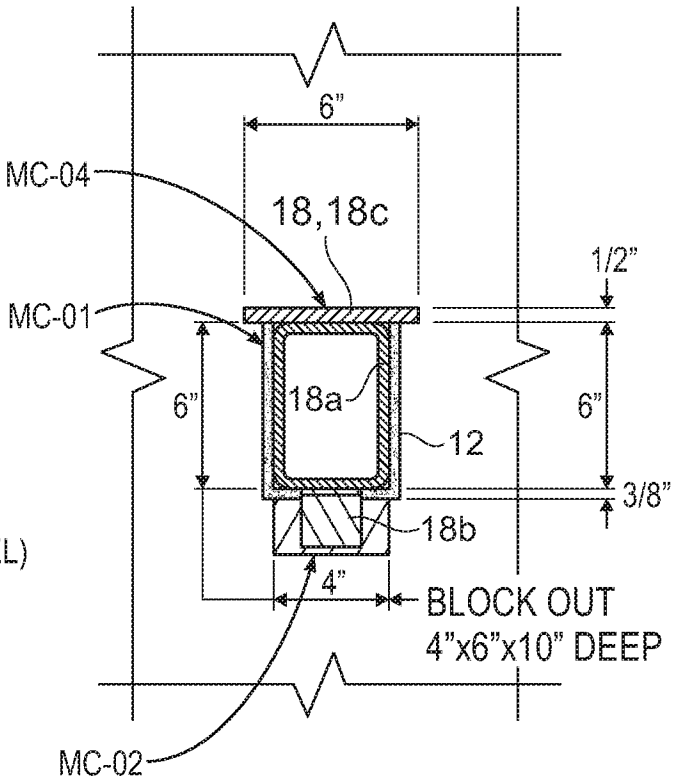
FIGS. 14A and 14B are section and elevation view assembly drawings of a further embodiment of a corbel in the present invention.
Figure 14A:
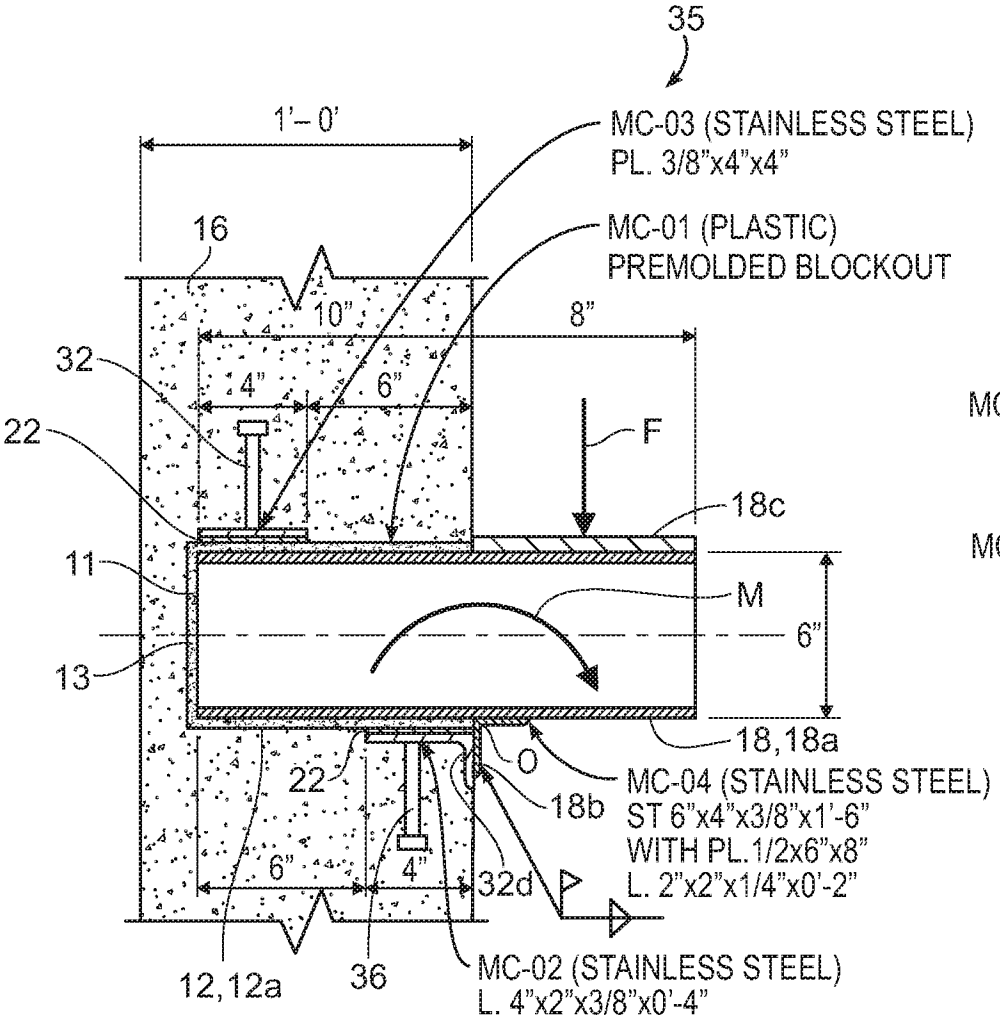
Figure 15A:
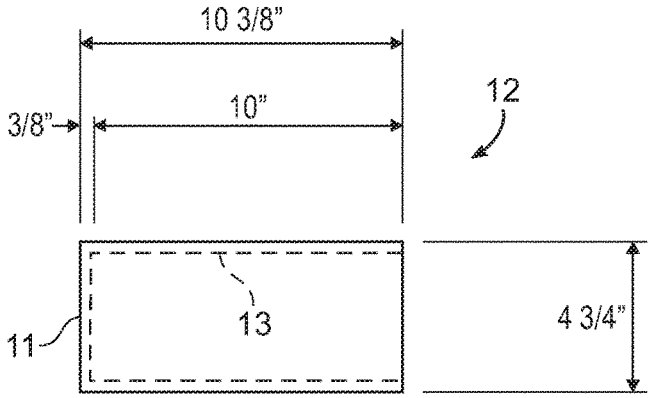
FIGS. 15A, 15B and 15C are top, side and front view detail drawings of the corbel outer sleeve or insert portion of the embodiment of FIGS. 14A and 14B.
Figure 15B:
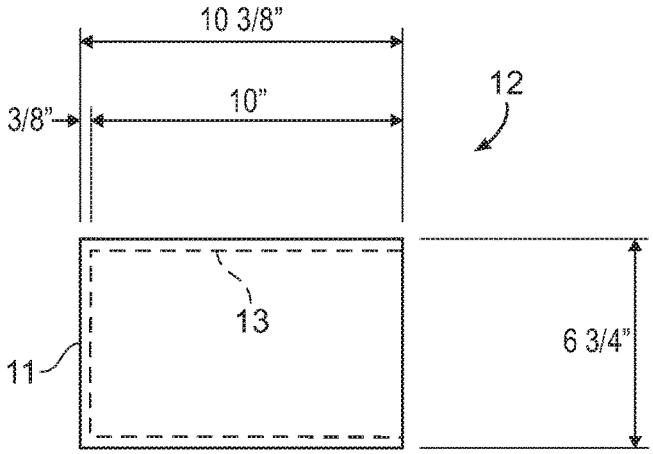
Figure 15C:
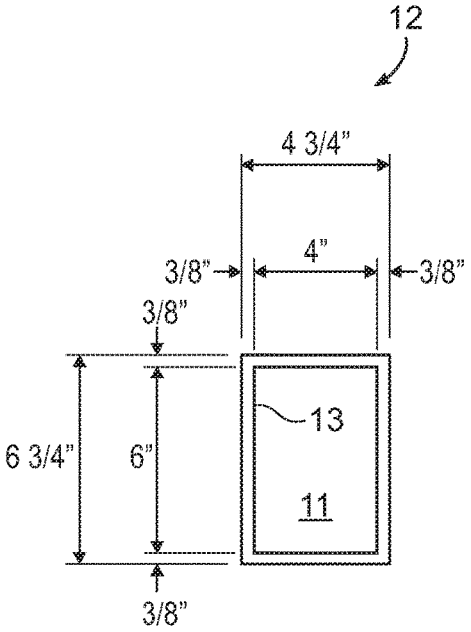
Figure 16A:
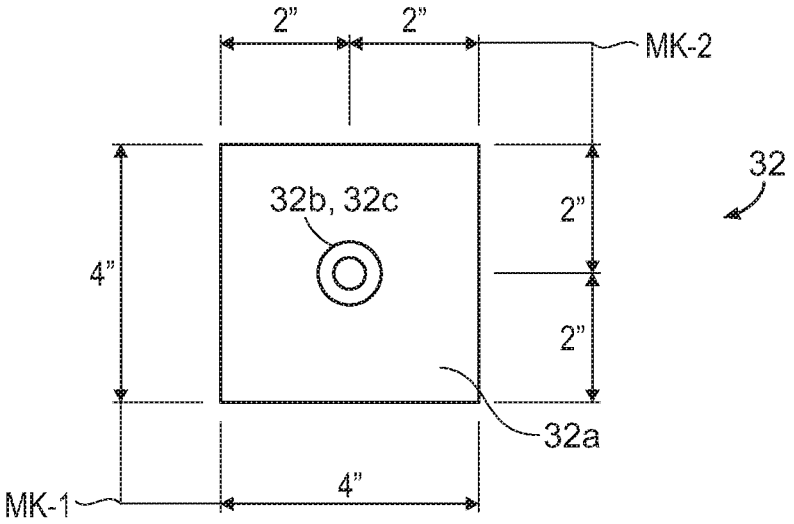
FIGS. 16A and 16B are top and side view detail drawings of one reinforcement member in the embodiment of FIGS. 14A and 14B.
Figure 16B:
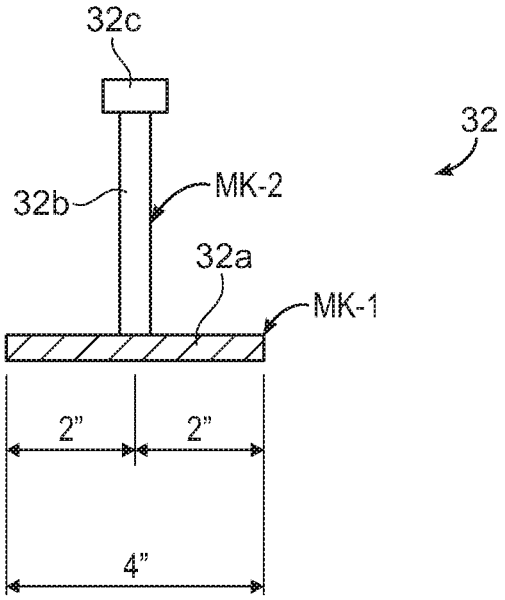
Figure 17A:
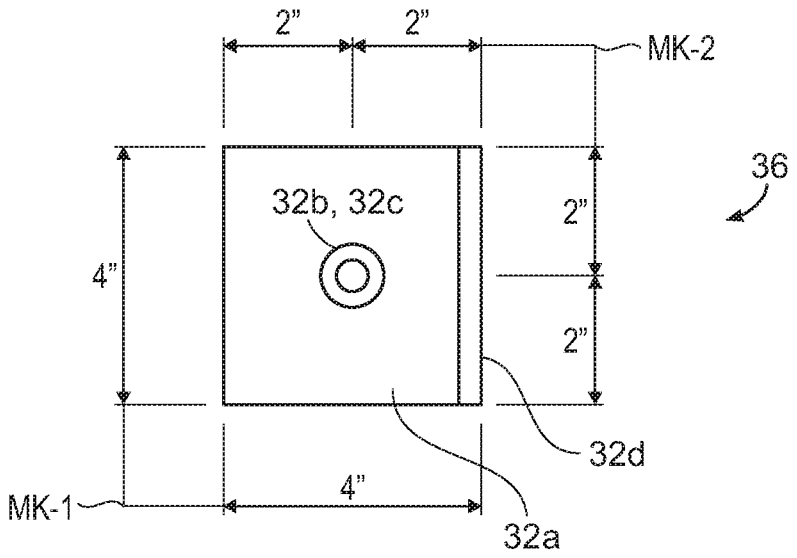
FIGS. 17A and 17B are top and side view detail drawings of another reinforcement member in the embodiment of FIGS. 14A and 14B.
Figure 17B:
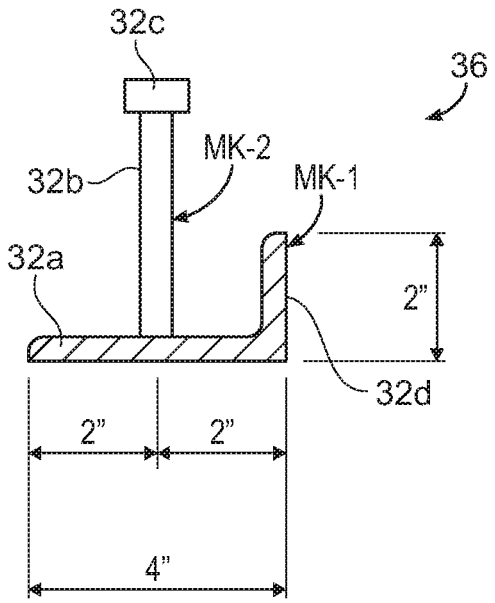
Figure 18A:
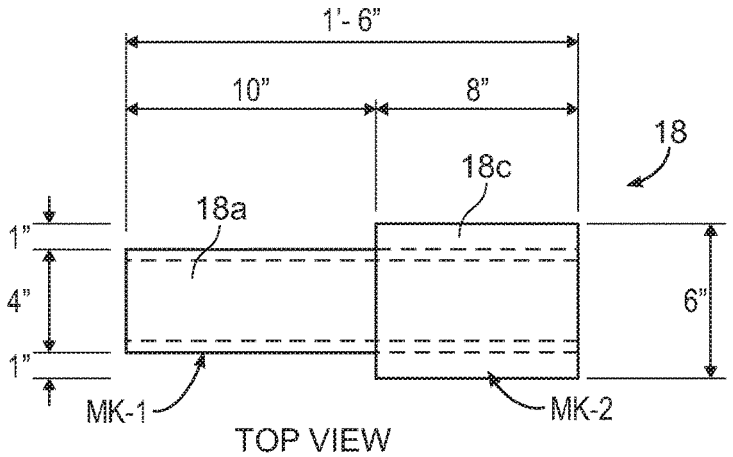
FIGS. 18A, 18B and 18C are top, side and front view detail drawings of the corbel extension portion of the embodiment of FIGS. 14A and 14B.
Figure 18B:
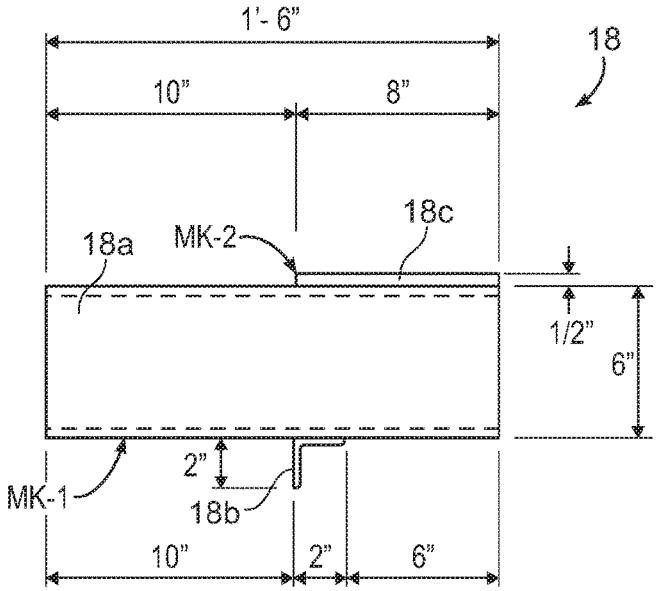
Figure 18C:
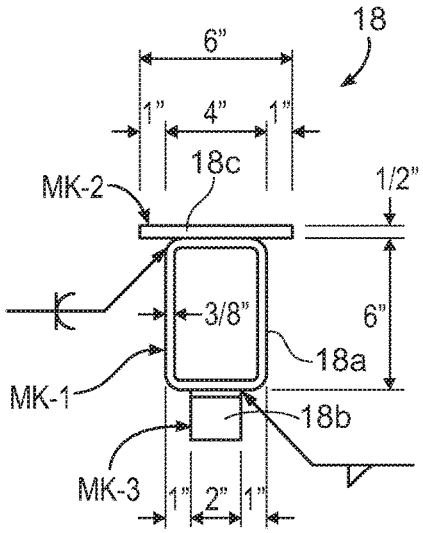

FIGS. 14A-18C show a further embodiment of a corbel 35 in the present invention which differs from the embodiment of FIGS. 11A-13C in that an insert portion 12 having an integral end cap 11 can be positioned or cast within wall 16. The insert portion 12 can be formed of steel or plastic. A reinforcement member 32 can be positioned or secured to the rear upper surface of insert portion 12 and another reinforcement member 36 can be positioned or secured to the front lower surface thereof such as previously described, within wall 16. The corbel extension 18 is inserted into the longitudinal channel 13 of the insert portion 12, such as in the embodiment of FIGS. 8A-10C. Reinforcement member 36 is similar to reinforcement member 32 but includes a flange 32*d* that extends at a right angle to plate 32*a* and downwardly. Corbel extension 18 differs from the one in FIGS. 8A-10C in that a flange 18*b* is secured to the bottom surface of the inner sleeve member 18*a* and extends downwardly for securement to flange 32*d* such as by bolts or welding. Further dimensions are found in FIGS. 14A-18C. In some embodiments, when a plastic insert portion 12 is employed, the insert portion 12 can hold two external load bearing or contact portions, members, elements, sheets or plates 22 for reinforcing the insert portion 12 or for contacting the reinforcement members 32 and 36. The plates 22 can form load bearing surfaces that can protect the plastic material. In other embodiments, plates 22 can be positioned on the inside of the insert portion 12 for contacting the corbel extension 18. Embodiments of the plates 22 can be made of a hard material such as steel or other suitable metals, ceramics, stone, brick or concrete, and in other embodiments can be made of suitable plastics or composites.

While example embodiments have been particularly shown and described, it will be understood by those skilled in the art that various changes in form and details may be made therein without departing from the scope of the embodiments encompassed by the appended claims. For example, in some embodiments, the corbel 10, outer sleeve member 12*a*, and/or corbel extension 18 can be angled. Various features or embodiments can be combined together or omitted. The corbels in the present invention can extend from walls, columns or other supporting structures, and can extend from more than one side, for example both sides of a wall. Structures other than double Tees can be supported, such as floors, roof sections, beams, etc. A wall, column or supporting structure can be formed with a pocket or insert portion 12 formed therein, and the corbel extension 18 inserted afterward. Various dimensions indicated can vary, and can be larger or smaller, depending upon the application at hand. The tubing for the insert portion 12 and the corbel extension 18 can have smaller cross-sectional dimensions or size than shown in the drawings, and does not have to be rectangular, but can be of other suitable shapes. Depending upon the application at hand, components of the corbels such as the insert portion 12, corbel extension 18 and reinforcement members 14, 32 and 36, can include or be made of carbon steel, stainless steel or galvanized steel. In some embodiments, the outer sleeve or insert portions 12 in the present invention can be formed of plastic such as a plastic sleeve and hold one or more load bearing or contact portions, members, elements, sheets or plates 22, such as two, at desired contact points or load bearing surfaces. The plates 22 can be for contacting the concrete, reinforcement members, and/or portions of the corbel extension portion or its flanges as desired, and can be made of the materials previously described above.

What is claimed is:

1. A corbel arrangement for supporting at least one double Tee beam having two stems comprising:

more than one corbel extending from a wall, the wall being formed of concrete and having wall reinforcement members extending substantially along a length and height of the wall;

each corbel comprising a corbel sleeve having a longitudinal passage for extending into the wall;

at least two upright elongate reinforcement members secured to the corbel sleeve by welding generally at opposite front and rear regions of the corbel sleeve and extending at least one of upwardly and downwardly therefrom for structurally engaging the wall reinforcement members within the wall for structurally supporting the corbel sleeve; and a corbel extension having an insertion end and a support end, the insertion end for inserting into the longitudinal passage of the corbel sleeve and securing therein along about a full length of the longitudinal passage for full passage length engagement therein, and the support end for extending from the corbel sleeve and the wall;

at least one double Tee beam having two stems; the more than one corbel supporting the at least one double Tee beam wherein each stem of the at least one double Tee beam is positioned on top of the support end of a corresponding corbel extension, the wall reinforcement members spreading loads that are directed parallel to a planar face of the wall and exerted on each corbel extension and corbel sleeve of the more than one corbel, over at least a majority of the length and height of the wall.

2. The corbel of claim 1 in which the at least two upright elongate reinforcement members comprises four upright elongate reinforcement bars extending upwardly and downwardly arranged in two longitudinally spaced pairs welded on opposite sides of the longitudinal passage of the corbel sleeve.

3. The corbel of claim 1 in which the corbel sleeve comprises rectangular tubing.

4. The corbel of claim 1 in which the corbel extension comprises rectangular tubing with a support plate being secured on the support end of the corbel extension to form a support surface.

5. The corbel of claim 1 in which the corbel sleeve comprises 5×7 inches × at least 0.25 inch wall steel rectangular tubing, and the corbel extension comprises 4×6 inches × at least 0.25 inch wall steel rectangular tubing.

6. A corbel arrangement for supporting at least one double Tee beam having two stems comprising:

at least one double Tee beam having two stems; more than one corbel extending from a wall, the wall being formed of concrete and having wall reinforcement members extending substantially along a length and height of the wall, each corbel comprising a corbel extension having an insertion end and a support end, the insertion end for inserting into the wall and securing therein, and the support end for extending from the wall, the more than one corbel supporting the at least one double Tee beam wherein each stem of the at least one double Tee beam is positioned on top of the support end of a corresponding corbel extension; and at least two upright elongate reinforcement members connected to the corbel extension generally at opposite front and rear regions of the wall and extending at least one of upwardly and downwardly relative to the corbel extension for structurally engaging the wall reinforcement members within the wall for structurally supporting the corbel extension, the wall reinforcement members spreading loads that are directed parallel to a planar face of the wall and exerted on each corbel extension of the more than one corbel, over at least a majority of the length and height of the wall.

7. The corbel of claim 6 further comprising a corbel sleeve having a longitudinal passage for extending into the wall, the at least two reinforcement members being secured to the corbel sleeve generally at opposite front and rear regions of the corbel sleeve, the insertion end of the corbel extension for inserting into the longitudinal passage of the corbel sleeve for securement therein along about a full length of the longitudinal passage for full passage length engagement therein.

8. A method of forming a corbel arrangement for supporting at least one double Tee beam having two stems comprising:

extending more than one corbel from a wall, each corbel comprising a corbel sleeve having a longitudinal passage extending into the wall, the wall being formed of concrete and having wall reinforcement members extending substantially along a length and height of the wall, at least two upright elongate reinforcement members being secured to the corbel sleeve by welding generally at opposite front and rear regions of the corbel sleeve and extending at least one of upwardly and downwardly therefrom for structurally engaging the wall reinforcement members within the wall for structurally supporting the corbel sleeve; and inserting an insertion end of a corbel extension into the longitudinal passage of the corbel sleeve and securing therein along about a full length of the longitudinal passage for full passage length engagement therein, the corbel extension also having a support end for extending from the corbel sleeve and the wall, the more than one corbel supporting at least one double Tee beam having two stems, wherein each stem of the at least one double Tee beam is positioned on top of the support end of a corresponding corbel extension, the wall reinforcement members spreading loads that are directed parallel to a planar face of the wall and exerted on each corbel extension and corbel sleeve of the more than one corbel, over at least a majority of the length and height of the wall.

9. The method of claim 8 in which the at least two upright reinforcement members comprises four upright elongate reinforcement bars extending upwardly and downwardly arranged in two longitudinally spaced pairs welded on opposite sides of the longitudinal passage of the corbel sleeve.

10. The method of claim 8 in which the corbel sleeve comprises rectangular tubing.

11. The method of claim 8 in which the corbel extension comprises rectangular tubing with a support plate being secured on the support end of the corbel extension to form a support surface.

12. The method of claim 8 which the corbel sleeve comprises 5×7 inches × at least 0.25 inch wall steel rectangular tubing, and the rectangular tubing of the corbel extension comprises 4×6 inches × at least 0.25 inch wall steel rectangular tubing.

13. A method of forming a corbel arrangement for supporting at least one double Tee beam having two stems comprising:

extending more than one corbel from a wall, the wall being formed of concrete and having wall reinforcement members extending substantially along a length and height of the wall, each corbel being formed by inserting an insertion end of a corbel extension into the wall and securing therein, the corbel extension also having a support end for extending from the wall, the more than one corbel supporting at least one double Tee beam having two stems wherein each stem of the at least one double Tee beam is positioned on top of the support end of a corresponding corbel extension; and connecting at least two upright elongate reinforcement members to the corbel extension generally at opposite front and rear regions of the wall and extending at least one of upwardly and downwardly relative to the corbel extension for structurally engaging the wall reinforcement members within the wall for structurally supporting the corbel extension, the wall reinforcement members spreading loads that are directed parallel to a planar face of the wall and exerted on each corbel extension of the more than one corbel, over at least a majority of the length and height of the wall.

14. The method of claim 13 further comprising extending a corbel sleeve having a longitudinal passage into the wall, the at least two reinforcement members being secured to the corbel sleeve generally at opposite front and rear regions of the corbel sleeve, the insertion end of the corbel extension for inserting into the longitudinal passage of the corbel sleeve for securement therein along about a full length of the longitudinal passage for full passage length engagement therein.

15. A method of supporting at least one double Tee beam having two stems comprising:

extending more than one corbel from a wall, the wall being formed of concrete and having wall reinforcement members extending substantially along a length and height of the wall, each corbel including a corbel sleeve having a longitudinal passage extending into the wall, at least two upright elongate reinforcement members being secured to the corbel sleeve by welding generally at opposite front and rear regions of the corbel sleeve and extending at least one of upwardly and downwardly therefrom for structurally engaging the wall reinforcement members within the wall for structurally supporting the corbel sleeve, a corbel extension having an insertion end and a support end has the insertion end inserted into the corbel sleeve and secured therein along about a full length of the longitudinal passage for full passage length engagement therein, the support end extends from the corbel sleeve and the wall; and supporting at least one double Tee beam having two stems with the more than one corbel wherein each stem of the at least one double Tee beam is positioned on top of the support end of a corresponding corbel extension, the wall reinforcement members spreading loads that are directed parallel to a planar face of the wall and exerted on each corbel extension and corbel sleeve of the more than one corbel, over at least a majority of the length and height of the wall.

16. The method of claim 15 in which the at least two upright reinforcement members comprises four upright elongate reinforcement bars extending upwardly and downwardly arranged in two longitudinally spaced pairs welded on opposite sides of the longitudinal passage of the corbel sleeve.

17. The method of claim 15 in which the corbel sleeve comprises rectangular tubing.

18. The method of claim 15 which the corbel extension comprises rectangular tubing with a support plate being secured on the support end of the corbel extension to form a support surface for supporting the load.

19. The method of claim 15 which the corbel sleeve comprises 5×7 inches × at least 0.25 inch wall steel rectangular tubing, and the corbel extension comprises 4×6 inches × at least 0.25 inch wall steel rectangular tubing.

20. A method of supporting at least one double Tee beam having two stems comprising:

extending more than one corbel from a wall, the wall being formed of concrete and having wall reinforcement members extending substantially along a length and height of the wall, each corbel including a corbel extension having an insertion end and a support end, with the insertion end being inserted into the wall and secured therein, the support end extends from the wall, at least two upright elongate reinforcement members being connected to the corbel extension generally at opposite front and rear regions of the wall and extend at least one of upwardly and downwardly relative to the corbel extension for structurally engaging the wall reinforcement members within the wall for structurally supporting the corbel extension; and supporting having two stems at least one double Tee beam with the more than one corbel wherein each stem of the at least one double Tee beam is positioned on top of the support end of a corresponding corbel extension, the wall reinforcement members spreading loads that are directed parallel to a planar face of the wall and exerted on each corbel extension of the more than one corbel, over at least a majority of the length and height of the wall.

21. The method of claim 20 further comprising extending a corbel sleeve having a longitudinal passage into the wall, the at least two reinforcement members being secured to the corbel sleeve generally at opposite front and rear regions of the corbel sleeve, the insertion end of the corbel extension for inserting into the longitudinal passage of the corbel sleeve for securement therein along about a full length of the longitudinal passage for full passage length engagement therein.

* * * * *